US007532092B2

(12) United States Patent
Chen

(10) Patent No.: US 7,532,092 B2
(45) Date of Patent: May 12, 2009

(54) GROUNDING STRATEGY FOR FILTER ON PLANAR SUBSTRATE

(75) Inventor: Qiang Richard Chen, Phoenix, AZ (US)

(73) Assignee: TDK Corporation, Tokyo (JP)

( * ) Notice: Subject to any disclaimer, the term of this patent is extended or adjusted under 35 U.S.C. 154(b) by 257 days.

(21) Appl. No.: 11/471,792

(22) Filed: Jun. 20, 2006

(65) Prior Publication Data

US 2007/0290771 A1 Dec. 20, 2007

(51) Int. Cl.
*H01P 1/20* (2006.01)
*H01P 3/08* (2006.01)

(52) U.S. Cl. ..... 333/204; 333/185; 333/186

(58) Field of Classification Search ..... 333/175, 333/177, 184–185, 202, 204
See application file for complete search history.

(56) References Cited

U.S. PATENT DOCUMENTS 5,304,921 A 4/1994 Cook et al.
5,777,533 A 7/1998 Kato et al.
6,411,178 B1 * 6/2002 Matsumura et al. ..... 333/134
6,414,568 B1 7/2002 Matsumura et al.
6,617,526 B2 9/2003 Miller
6,853,070 B2 2/2005 Khan et al.
6,940,157 B2 9/2005 Sugiyama et al.
2002/0030555 A1 * 3/2002 Mandai et al. ..... 333/133
2002/0063611 A1 * 5/2002 Tojyo et al. ..... 333/185

FOREIGN PATENT DOCUMENTS

DE 19619710 A1 11/1996
EP 1067618 A 1/2001
GB 2383702 A 7/2003

OTHER PUBLICATIONS

"Techniques to Achieve High Isolation with GaAs MMIC Switch Chips"; M/A-COM Inc.

* cited by examiner

*Primary Examiner*—Anh Q Tran
(74) *Attorney, Agent, or Firm*—Allen J. Moss; Alex Starkovich; Squire, Sanders & Dempsey L.L.P.

(57) ABSTRACT

The invention provides a grounding strategy for electronic components. In particular, the present provides ground connections in thin-film electronic components by connecting one group of one or more resonators to one ground connection and connecting a second group of one or more resonators to another ground connection.

15 Claims, 19 Drawing Sheets

CIRCUIT SCHEMATIC

THE INPUT/OUTPUT COUPLING CAPACITOR
(C4 AND L4 IN SLIDE 6) IS DELETED

GROUNDING STRATEGY FOR FILTER ON PLANAR SUBSTRATE

FIELD OF THE INVENTION

The present invention relates to a grounding strategy for electronic components, and more specifically to a ground strategy for filters on a planar substrate.

BACKGROUND OF THE INVENTION

Electronic components, and particularly electronic filters, built on substrates using microstrip or stripline technology often have on-chip circuit ground connected to a system ground plane at a different level of the chip substrate. Conventionally, without using complex flip-chip technology developed in recent years, these ground connections can be realized with via-holes, bond-wires or side-wall metallic terminations, as is shown in FIG. 1. In filter applications, these ground connections bring associated parasitic inductance which may deteriorate filter performance; especially at upper stop-bands since parasitic inductance more greatly affects higher frequency signals. This is due to the proportional relationship between inductor reactance and frequency.

In via-hole applications, more via holes that connect circuit nodes to ground may be employed to reduce the total parasitic ground inductance related to a ground connection. Since via holes may be used to more directly connect components to ground, lower total parasitic inductance can be achieved. However, the process for creating via holes is slow and expensive especially for etching processes. Similarly, in wire-bond applications, additional wires may be used to connect circuit nodes to ground. However, additional wire-bonds need enlarged bonding pad surfaces and access room to the pads. As for sidewall termination applications, typically there are four sidewalls at each side of rectangular-shaped components. Among these four sidewall terminations, typically two are used for input and output signal ports and only two terminations are for used ground connections. Consequently the number of possible ground connections is limited.

SUMMARY OF THE INVENTION

In view of the foregoing, the invention provides a grounding strategy for electronic components. In particular, the present invention reduces feedback effect associated with common ground connections in thin-film electronic components by connecting one group of one or more resonators to one ground connection and connecting a second group of one or more resonators to another ground connection. This strategy reduces the feedback effect of the common ground inductance to all resonators. The filter outband rejection performance deterioration caused by common ground inductance is reduced. Due to this separate ground path, additional transmission zeros may be generated in the stop-band and can be individually tuned to frequency locations where maximum attenuations are desired.

According to one embodiment, the invention provides an electronic component that includes a first group of one or more resonators located in a first group of two or more thin-film layers, a second group of one or more resonators located in a second group of two or more thin-film layers, a first ground connection, and a second ground connection. Each resonator in the first group of one or more resonators is connected to the first ground connection and each resonator in the second group of one or more resonators is connected to the second ground connection. In this way, interference among resonators caused by parasitic ground inductance of the electronic component may be reduced and performance of the component improved.

According to another embodiment of the invention, the first group of two or more thin-film layers and the second group of two or more thin-film layers are the same.

According to still another embodiment of the invention, the first ground connection and the second ground connection may be implemented as sidewall terminations.

According to yet another embodiment of the invention, the connection of the first group of one or more resonators to the first ground connection has a first ground inductance and the connection of the second group of one or more resonators to the second ground connection has a second ground inductance, the first ground inductance being different from the second ground inductance.

According to another embodiment of the invention, the first group of one or more resonators has substantially the same size and shape as each other, while the second group of or one or more resonators has a different size and/or shape than the first group of resonators of one or more resonators.

According to still another embodiment of the invention, the first group of one or more resonators consists of two resonators, the second group of one or more resonators consists of one resonator, the first group of two or more thin-film layers consists of two thin-film layers, and the second group of two or more thin-film layers consists of two thin-film layers.

According to yet another embodiment of the invention, the electronic component further includes a rectangular-shaped housing having two longer sides and two shorter sides, an input connection, and an output connection. The first and second ground connections are constructed as sidewall terminations on the two longer sides of the housing and the input connection and the output connection are constructed as sidewall terminations on the two shorter sides of the housing.

According to still another embodiment of the invention, the electronic component further includes a rectangular-shaped housing having two longer sides and two shorter sides, an input connection, and an output connection. The first and second ground connections are constructed as sidewall terminations on the two shorter sides of the housing and the input connection and the output connection are constructed as sidewall terminations on the two longer sides of the housing.

According to another embodiment, the invention provides a method for determining the shape and size of a resonator in a thin-film filter wherein a first group of one or more resonators of pre-estimated shape and size are connected to a first ground connection and a second group of one or more resonators of pre-estimated shape and size is to be connected to a second ground connection. The method includes the steps of (1) selecting a center passband frequency for the thin-film filter, (2) estimating inductor starting size and shape in both the first and second group of resonators, (3) calculating the second and the third harmonic frequency for the thin-film filter based on the selected center passband frequency, (4) selecting a routing for the first and the second ground connections, respectively, (5) determine respective ground inductances associated with the first and the second ground connection, (6) determining a parasitic inductance associated with the first ground connection, (7) calculating a capacitance for the resonators in the first group from the second harmonic frequency, the ground inductance, and the parasitic inductance, (8) calculating an inductance for the resonators in the first group from the selected center passband frequency and the calculated capacitance for the resonators in the first group, (9) adjusting a shape and size for the resonators in the first group based on the calculated capacitance and inductance for the first group of resonators, (10) determining a parasitic inductance associated with the second ground connection, (11) calculating a capacitance for the resonators in the second group from the third harmonic frequency, the ground inductance, and the parasitic inductance, (12) calculating an inductance for the resonators in the second group from the selected center passband frequency and the calculated capacitance for the resonators in the second group, and (13) adjusting a shape and size for the resonators in the second group based on the calculated capacitance and inductance for the second group of resonators.

It is to be understood that the descriptions of this invention herein are exemplary and explanatory only and are not restrictive of the invention as claimed.

DESCRIPTION OF THE EMBODIMENTS

Reference will now be made in detail to the present exemplary embodiments of the invention, examples of which are illustrated in the accompanying drawings.

The present invention provides a grounding strategy for electronic component, and in particular, a grounding strategy for filters having a planar substrate. For example, this grounding strategy is applicable for use electronic components constructed with any thin-film technique.

Figure 1:
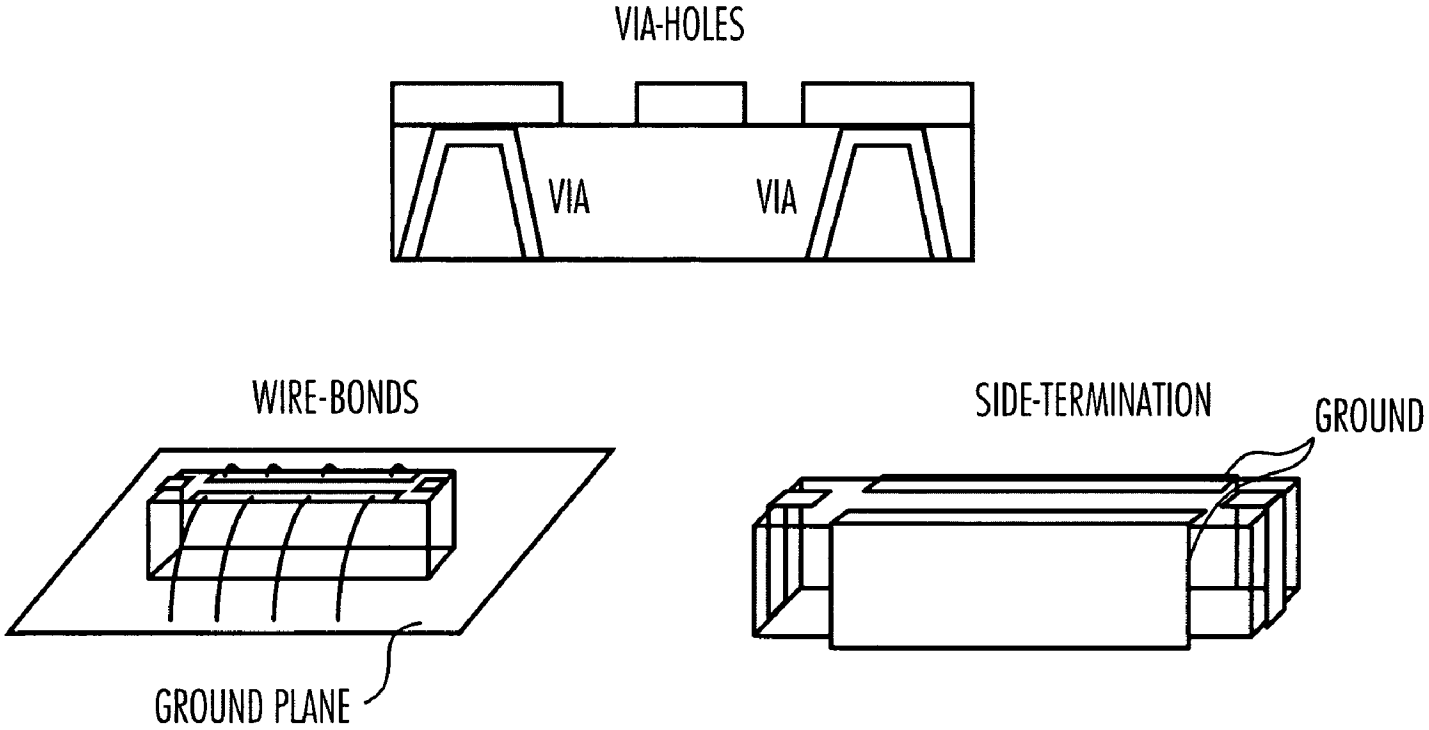
Figure 1 (PRIOR ART)
FIG. 1 depicts conventional ground connection strategies.
Figure 2A:
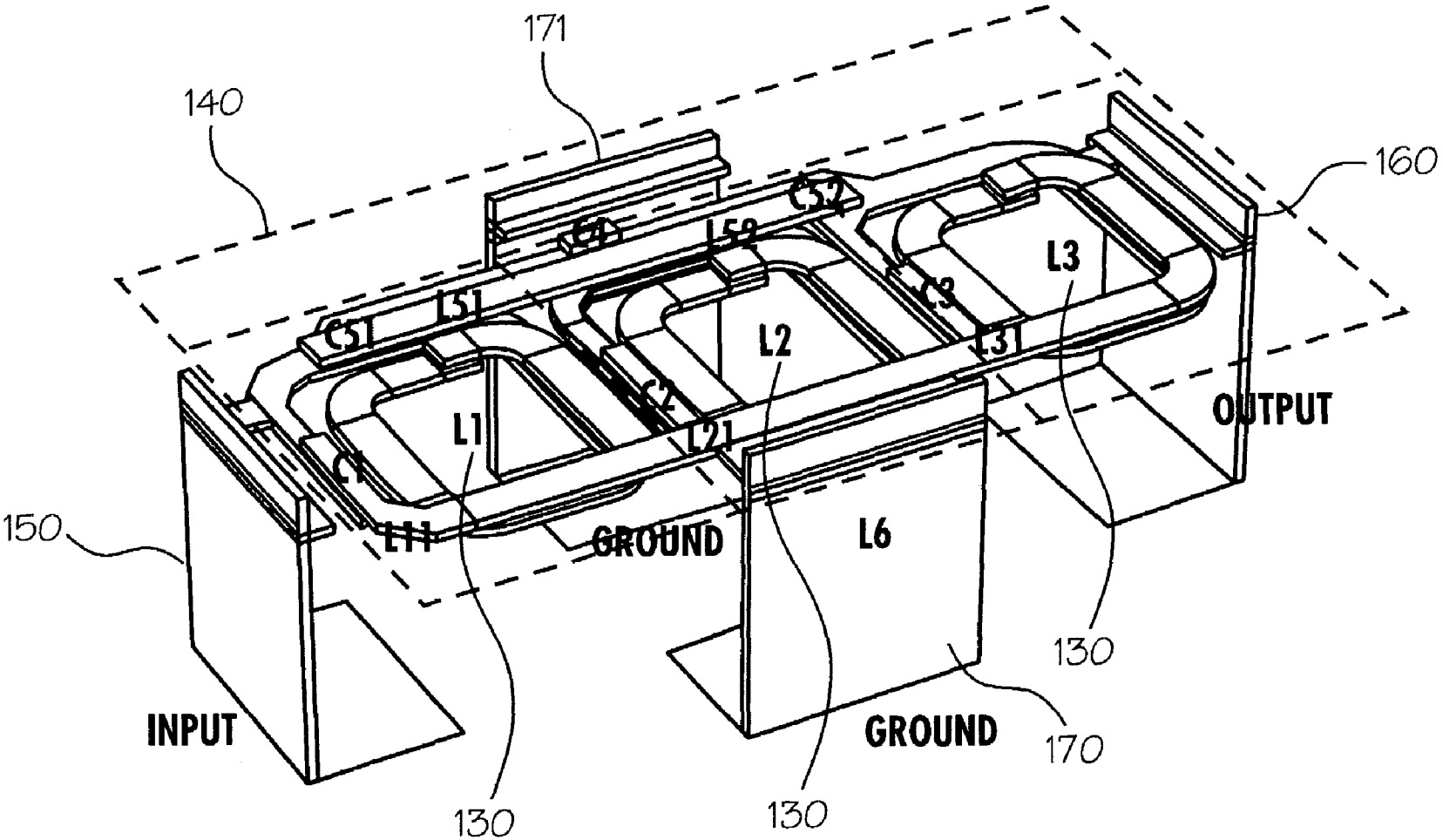
FIG. 2*a* depicts an isometric view of a physical layout of a bandpass filter.
Figure 2B:
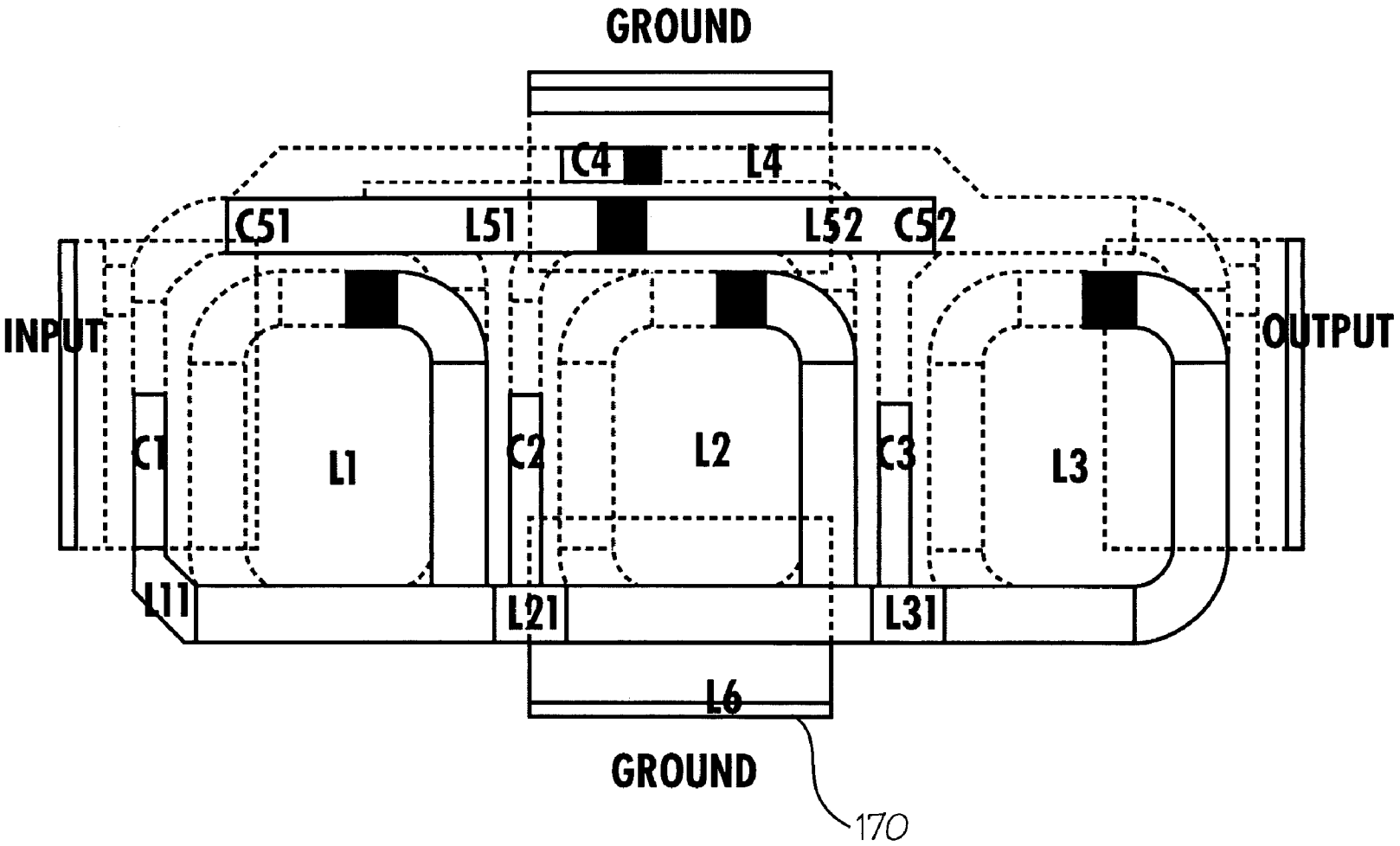
FIG. 2*b* depicts a physical layout of the top metal layer of the bandpass filter shown in FIG. 2*a*.
Figure 3:
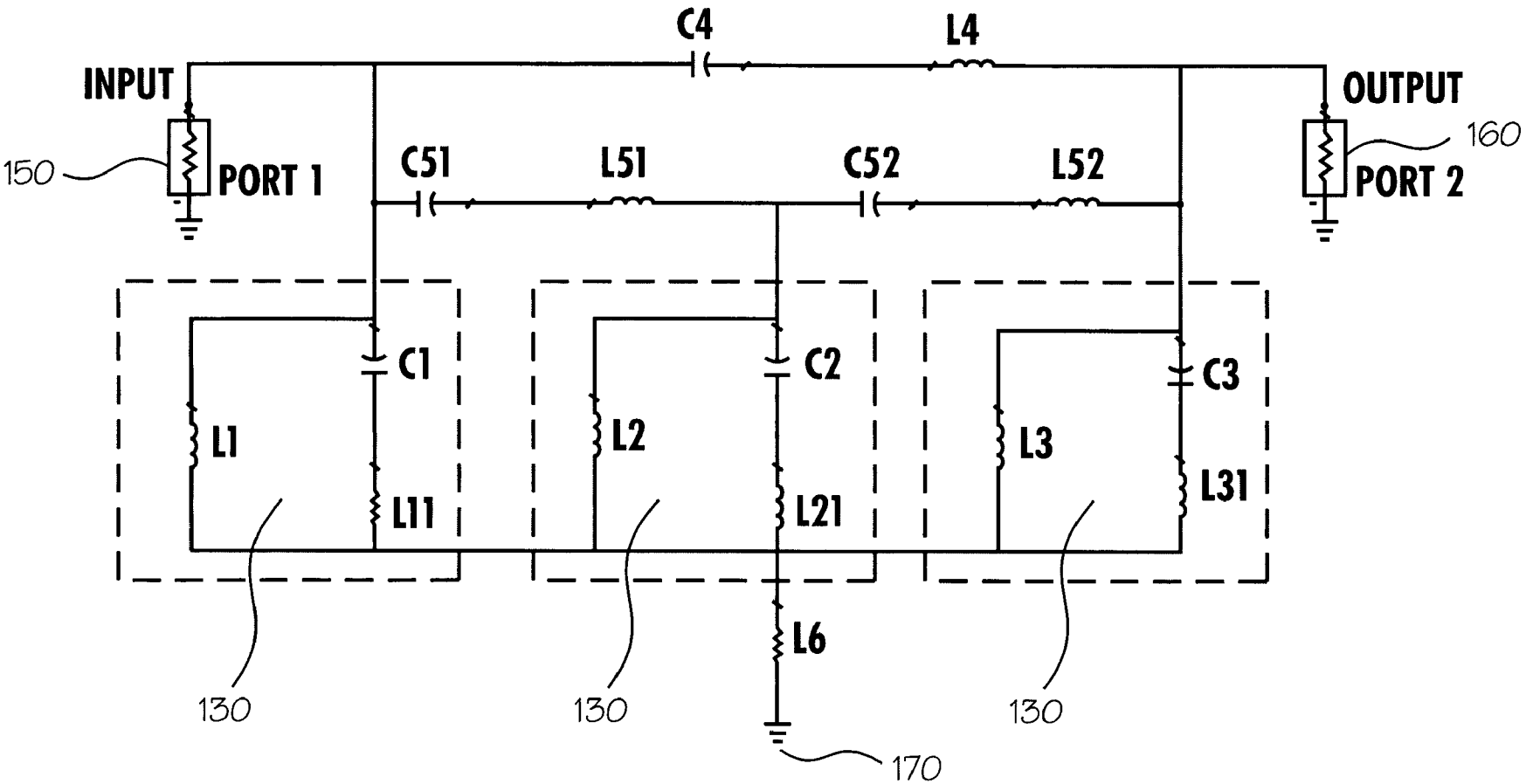
FIG. 3 depicts a schematic of the bandpass filter shown in FIG. 2*a*.

Conventional thin-film filters with side-wall terminations typically exhibit a ground inductance of approximately 0.16 nH for a housing size of 1 mm by 0.5 mm and a substrate thickness of 0.3 mm. FIGS. 2*a* and 2*b* show an example structure of such a bandpass filter with three resonators and FIG. 3 shows its circuit schematic diagram. The bandpass filter in FIG. 2*a* has three LC resonators 130 each connected to ground 170 through inductor L6. Ground 170 is configured as a sidewall termination. Three additional sidewall terminations function as an input terminal 150, an output terminal 160, and another ground connection 171 which is idle. Section 140 in FIG. 2*a* serves as a coupling network for coupling the three resonators together and to the input and output terminals. FIG. 2*b* shows a top view of the top layer of the bandpass filter in FIG. 2*a*. FIG. 2*b* more clearly shows that each of the three LC resonators (L1/C1/L11; L2/C2/L21; L3/C3/L31) are connected to ground connection 170 through inductor L6. FIG. 3 shows the schematic for the layout shown in FIGS. 2*a* and 2*b*. Again, each of the LC resonators is connected to a single ground connection 170 through inductor L6. The ground connection at the lower chip edge (170) is used for convenient connection to this filter structure, while the other ground terminal (171) at the upper edge is idle.

Figure 4:
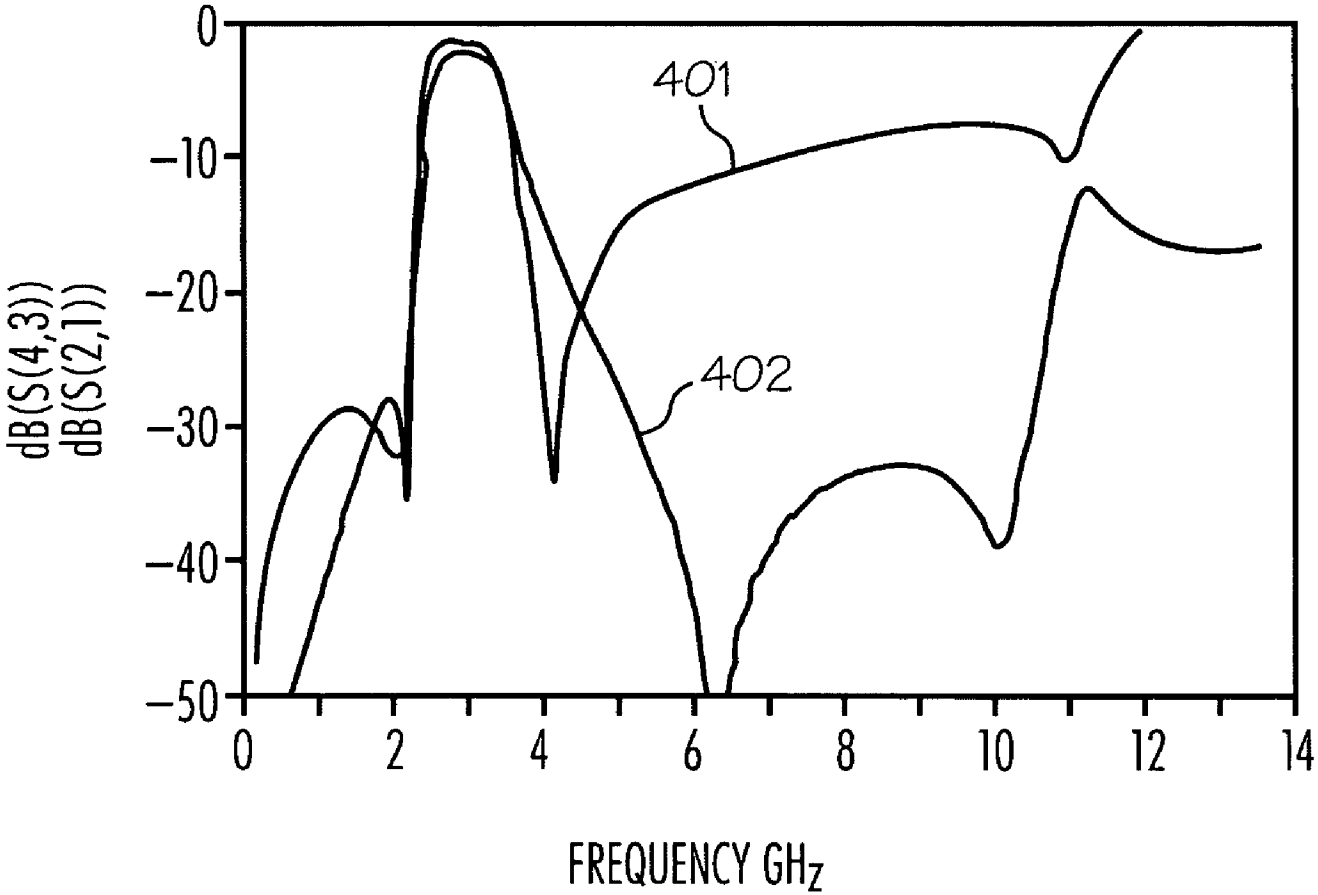
FIG. 4 depicts a frequency response of a bandpass filter according to one embodiment of the invention.

The filter performance with and without the 0.16 nH common ground inductance (L6 in FIGS. 2*a*, 2*b*, and 3) is shown in FIG. 4. Response 402 shows the response of the filter without any common ground inductance, while response 401 shows the response of the filter with 0.16 nH of ground inductance. As can be seen in the FIG. 4, the absence of common ground inductance produces a larger amount of attenuation in both the upper and lower stopbands. It can be seen that outband rejection performance in upper stopband deteriorated more than 20 dB with common ground inductance, which functions as a coupling inductor among the three resonators. Different variations to the filter internal structure have been tried to improve the out-band performance, but limited improvement has been achieved.

Figure 5:
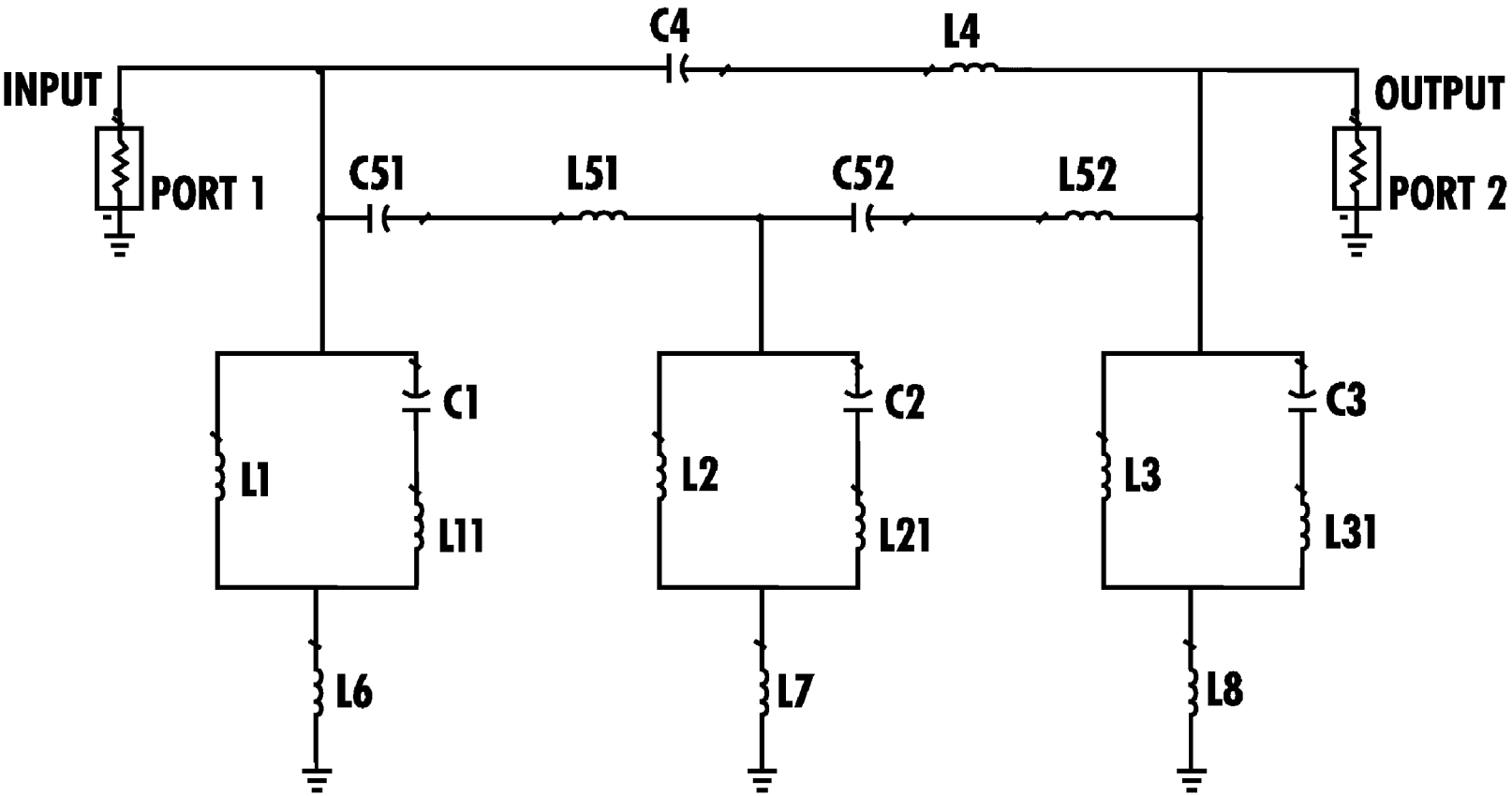
FIG. 5 depicts a schematic of the bandpass filter according to one embodiment of the invention.

FIG. 5 shows a filter schematic with separate ground connections according to one embodiment of the invention. As can be seen in FIG. 5, each resonator (L1/C1/L1; L2/C2/L21; L3/C3/L31) are connected to ground through separate ground inductors (L6, L7, and L8). Compared with schematic shown in FIG. 3 where a single common ground connection (L6) was used, separate connection represented by inductance L6, L7 and L8 for each of the three LC resonators are used. This connection arrangement eliminates undesired ground coupling among the three resonators.

Due to process limitations and industry standards currently used, a sidewall termination has minimum required dimensions. Therefore for a particular case size for a SMD (surface mount device) component, the number of sidewall terminations may be limited. In the case of a 1 mm by 0.5 mm case size thin-film filter, there are typically only four sidewall terminations available, among which 2 sidewall terminations are used for input and output ports. Consequently there are only 2 sidewall terminations available for use as ground connections. In the filter design shown in FIG. 5, three LC resonators are used. As such, two resonators would share one ground connection in order to fit into the case size with 4 sidewall terminations.

Figure 6A:
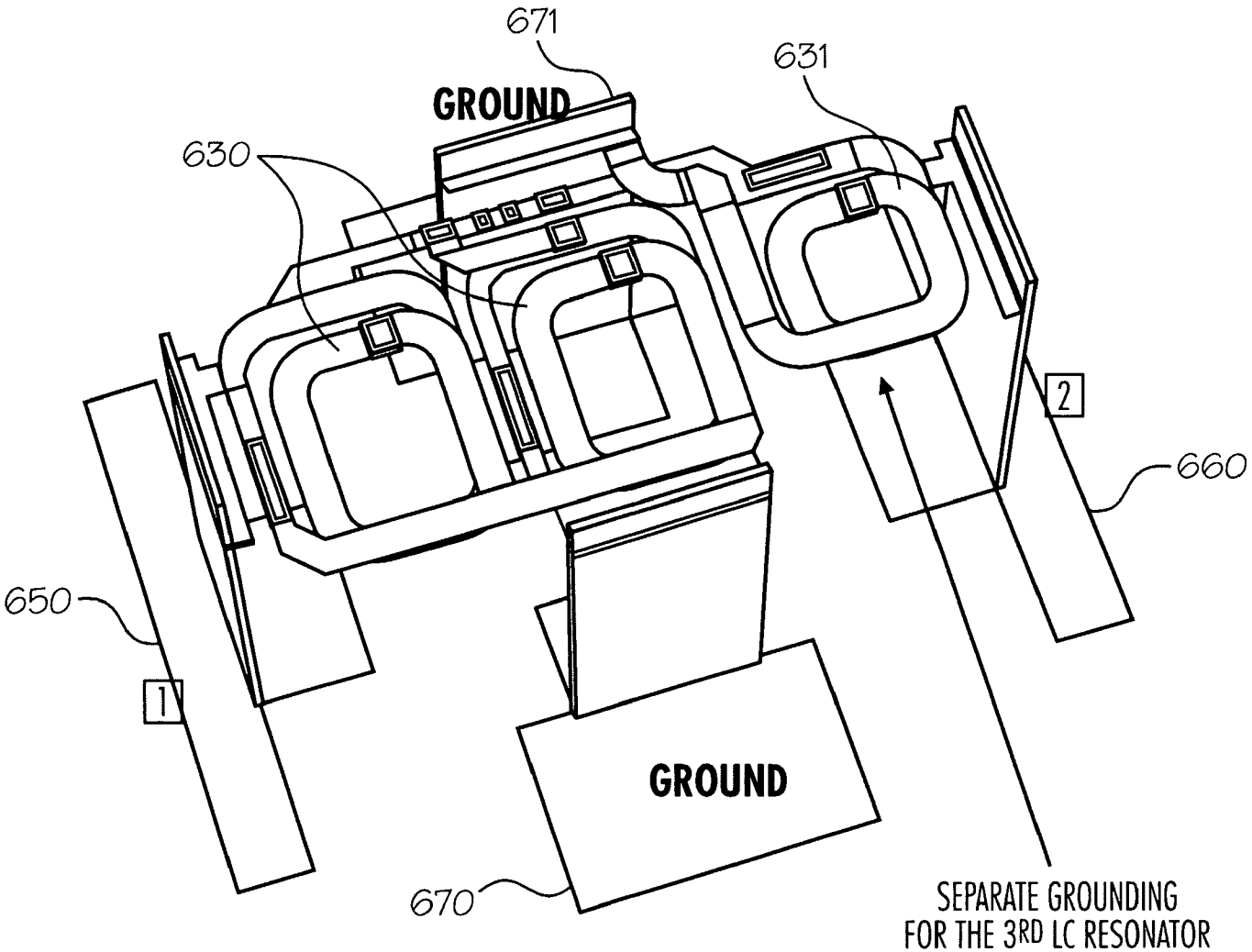
FIG. 6*a* depicts an isometric view of a physical layout of a bandpass filter according to one embodiment of the invention.

FIG. 6*a* shows an isometric view of bandpass filter physical layout having three LC resonators in a package with four sidewall terminations. The layout shown in FIG. 6*a* is a bandpass filter that is to be constructed in a 1 mm by 0.5 mm form factor with sidewall packaging. The resonators 630 and 631 are constructed as lumped inductor and capacitor resonators. For the same inductance value, a coil inductor occupies less space than that of a piece of transmission line because the magnetic fluxes are shared by every coil turns and consequently, this increases inductance density per area. By carefully examining filter performance with optimized circuit structures, the left and middle resonators 630 are chosen to share the lower ground connection 670, while the third resonator 631 is connected to the separate upper ground termination 671. The remaining two sidewall terminations are used as input terminal 650 and output terminal 660.

In the filter layout drawings shown in FIGS. 5 and 6*a*, L1, L11 and C1 form a first resonator 630, L2, L21 and C2 a second resonator 630, and L3, L31 and C3 a third resonator 631. C51 and L51 are the interconnection (coupling) circuit between the first and the second resonators. C52 and L52 are the interconnection (coupling) circuit between the second and third resonators. C4 and L4 are the coupling circuit between filter input 150 and output 160 ports as well as between the first and third resonators. Together the coupling circuits formed by C51 and L51, C52 and L52, and C4 and L4 make up coupling network 140. Such a coupling network may be arranged in any manner possible to produce the desired frequency response characteristics of the bandpass filter.

The structure shown in FIG. 6*a* is a thin-film structure having two metal layers. However, the invention is applicable for use with thin-film structures having two or more thin-film layers. In addition, while the filters shown in FIG. 6*a* depict the use of 3 resonators, the invention is applicable for use with filters having one or more resonators. Furthermore, the invention is not limited for use with bandpass filters, but may be used with any electronic component that utilizes resonators.

Figure 6B:
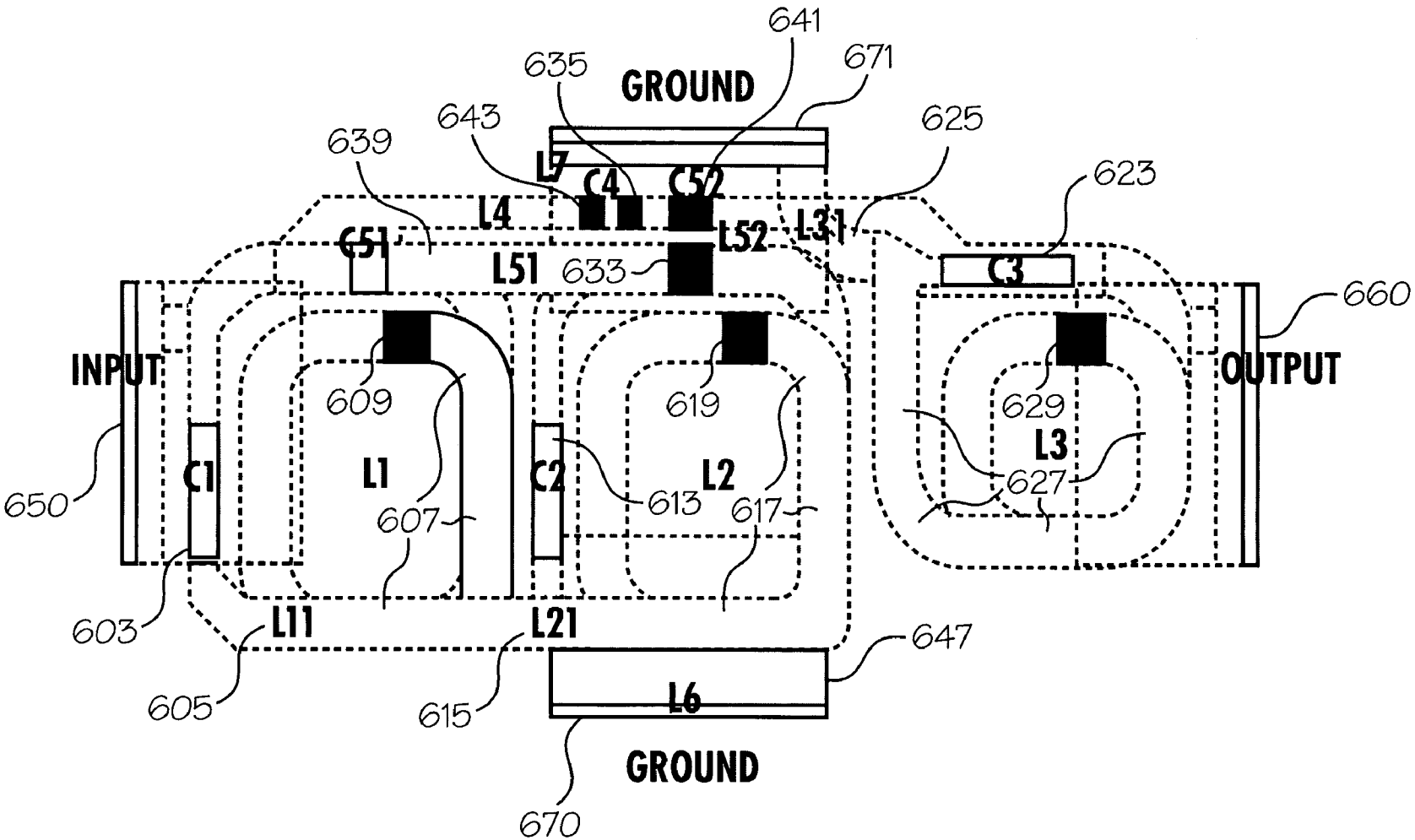
FIG. 6*b* depicts a physical layout of the top metal layer of the bandpass filter shown in FIG. 6*a* according to one embodiment of the invention.
Figure 6C:
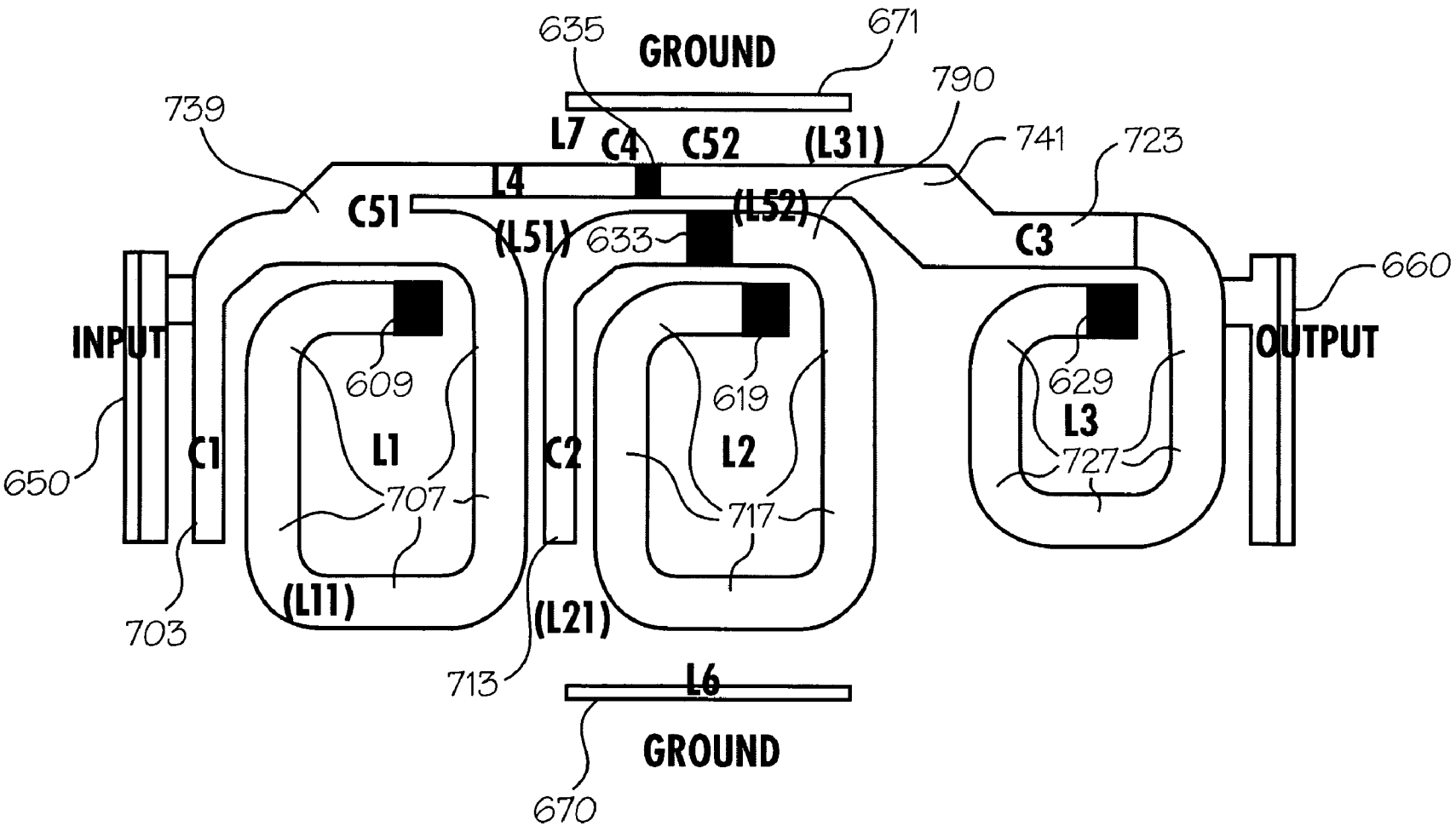
FIG. 6*c* depicts a physical layout of the bottom metal layer of the bandpass filter shown in FIG. 6*a* according to one embodiment of the invention.

FIG. 6*b* depicts a physical layout of the top layer of the bandpass filter shown in FIG. 6*a*. FIG. 6*c* depicts a physical layout of the bottom layer of the bandpass filter shown in FIG. 6*a*. It should be noted that the top and bottom layers depicted in FIGS. 6*b* and 6*c* may be reversed.

As shown in FIG. 6*b*, the first (L1, L11, and C1), second (L2, L21, and C2), and third (L3, L31, C3) resonators are partially formed in the top metal layer. Metal region 603 forms the top plate of a metal-insulator-metal (MIM) capacitor C1. Metal region 603 (C1) is connected to metal regions 607 (L1) via metal region 605 (L11). Metal region 607 (L1) is connected to the remainder of inductor L1 on the bottom layer through via 609. Functionally, metal regions 603 and 605 together create an inductor L11 in series with capacitor C1 formed by metal region 603. This series LC circuit (i.e., C1 and L11) is in parallel with inductor L1 to form an LC resonator.

Metal region 607 (L1) is connected to metal region 615 (L21) to connect the first LC resonator (L1, L11, and C1) to the second LC resonator (L2, L21, and C2). Metal region 613 forms the top plate of MIM capacitor C2. Metal region 613 (C2) is connected to metal regions 617 (L2) via metal region 615 (L21). Metal region 617 (L2) is connected to the remainder of inductor L2 on the bottom layer through via 619. Functionally, metal regions 613 and 615 together create an inductor L21 in series with capacitor C2 formed by metal region 613. This series LC circuit (i.e., C2 and L21) is in parallel with inductor L2 to form an LC resonator.

Metal region 623 forms the top plate of MIM capacitor C3. Metal region 623 (C3) is connected to metal regions 627 (L3) and to metal region 625 (L31). Metal region 627 (L3) is connected to the remainder of inductor L3 on the bottom layer through via 629. Functionally, metal regions 623 and 625 together create an inductor L31 in series with capacitor C3 formed by metal region 623. This series LC circuit (i.e., C3 and L31) is in parallel with inductor L3 to form an LC resonator.

The first two LC resonator circuits (L1/C1/L11 and L2/C2/L21) are tied to ground 670 (here a sidewall termination) through metal region 647. Functionally, metal regions 647 and sidewall ground connection 670 together create a ground inductor L6. Metal region 647 is connected to metal region 617 (L2) which in turn is connected to metal region 607(L1) through metal region 615 (L11). The third resonator (L3/C3/L31) is connected to ground 671 (here a sidewall termination, L7 in FIG. 8) through metal region 625 (L31).

A coupling network is also partially contained in the top metal layer. Metal region 639 forms both the top plate of MIM capacitor C51 and inductor L51. Likewise metal region 641 forms both the top plate of MIM capacitor C52 and inductor L52. Metal regions 639 and 641 are connected to the remainder of the coupling network on the bottom layer through via 633. In addition, metal region 643 forms the top plate of MIM capacitor C4. This capacitor is connected to the remainder of the coupling network on the bottom layer through via 635.

Turning now to the bottom layer shown in FIG. 6*c*, metal region 650 (input terminal) is connected to metal region 703 (C1). Metal region 703 forms the bottom plate of MIM capacitor C1. Metal region 703 is connected to metal region 739 which forms the bottom plate of MIM capacitor C51. Metal region 739 (C51) is also connected to metal regions 707 which form the other portion of inductor L1 in the bottom layer. This portion of inductor L1 is connected to the remainder of the inductor on the upper layer through via 609.

Metal region 713 forms the bottom plate of MIM capacitor C2. Metal region 713 is connected to metal region 790 which in turn connects the second resonator (i.e., L2, L21, and C2) to the coupling network through via 633. Metal region 790 is also connected to metal regions 717 which form the other portion of inductor L2 in the bottom layer. This portion of inductor L2 is connected to the remainder of the inductor on the upper layer through via 619.

Metal region 723 forms the bottom plate of MIM capacitor C3. Metal region 723 is connected to metal region 741 which forms the bottom plate of MIM capacitor C52. Metal region 723 (C3) is also connected to metal regions 727 which form the other portion of inductor L3 in the bottom layer. This portion of inductor L1 is connected to the remainder of the inductor on the upper layer through via 629. Metal region 723 (C3) is also connected to metal region 660 (output port).

Turning now to the remainder of the coupling network, metal region 741 forms the lower plate of MIM capacitor C4 and a portion of inductor L4. Metal region 741 connects to the remainder of the coupling network, specifically metal region 643 (the upper plate of capacitor C4), through via 635.

As can be seen in FIG. 6*a-c*, the first two resonators 630 are of substantially the same size and shape while the third resonator 631 is of a different size and shape. Because the third resonator has a different ground inductance than the first two resonators, its shape may be altered to maintain a substantially similar frequency response (in this case, the same passband) as a circuit with three identical LC resonators all connecting to the same ground. As such, the third LC resonator components L3 and C3 need to be designed to meet both the resonant frequency requirement of the LC resonator (normally close to the center of the required passband frequency) and frequency requirement of an extra transmission zero desired in the attenuation band. Formulas for approximate calculations on L3 and C3 will be given below.

The following steps may be used for determining the shape and size of a resonator in a thin-film filter wherein a first group of one or more resonators of pre-estimated shape and size are connected to a first ground connection and a second group of one or more resonators of pre-estimated (or undetermined) shape and size is to be connected to a second ground connection. The first step is to select a center passband frequency for the thin-film filter. Next, an initial inductor size and shape is selected for the first and second group of resonators that will produce a frequency response with the selected center passband frequency. Then, the second and the third harmonic frequency for the thin-film filter are calculated. These frequencies will determine where the transmission zeros will be located in the frequency response.

Once the desired frequency response and initial inductor size and shape have been determined, a routing for the first and second ground connections is chosen. Based on this routing, a ground inductance associated with the first and the second ground connection is determined. In addition, a parasitic inductance associated with the first ground connection is also determined. Based on the determined ground inductance and parasitic inductance for the first ground connection, and the second harmonic frequency calculated from the center passband frequency, a capacitance value for the resonators in the first group is calculated. This value may be calculated using the following equation for second harmonic frequency $f_2$:

$$f_2 \approx \frac{1}{2\pi\sqrt{(L_{11}+L_6)C_1}}$$

$L_{11}$ is the parasitic inductance of the first resonator shown in FIG. 6*a*, while $L_6$ is the ground inductance for the first group of resonators. The second harmonic frequency is represented by $f_2$. Each of these values is known, and as such, the above equation may be rearranged and solved for $C_1$. The same formula may be used to solve for $C_2$ (L21 is substituted for L11). Once the capacitance values for the first group of resonators are calculated, the inductance of the second group of resonators may be adjusted utilizing the following equation:

$$f_0 \approx \frac{1}{2\pi\sqrt{L_{1/2}C_{1/2}}}$$

Once the inductance and capacitance values for the first group of resonators are calculated, the shape and size for the inductors and capacitors in the first group based may be selected.

Next, the parasitic inductance associated with the second ground connection is determined. Based on the determined ground inductance and parasitic inductance for the second ground connection, and the selected third harmonic frequency, a capacitance value for the resonators in the second group is calculated. This value may be calculated using the following equation:

$$f_3 \approx \frac{1}{2\pi\sqrt{(L_{31}+L_7)C_3}}$$

$L_{31}$ is the parasitic inductance of the third resonator 631 shown in FIG. 6*a*, while $L_7$ is the ground inductance for the second group of resonators. The third harmonic frequency is represented by $f_3$. Each of these values is known, and as such, the above equation may be rearranged and solved for $C_3$. Once the capacitance values for the second group of resonators are calculated, the inductance of the second group of resonators may be adjusted utilizing the following equation:

$$f_0 \approx \frac{1}{2\pi\sqrt{L_3C_3}}$$

$C_3$ is known from the previous calculation while $f_0$ is the previously-selected center frequency. The equation may be simply rearranged to solve for $L_3$. Next, the shape and size for the inductors and capacitors in the second group is selected and/or adjusted based on the calculated capacitance and inductance.

Figure 7:
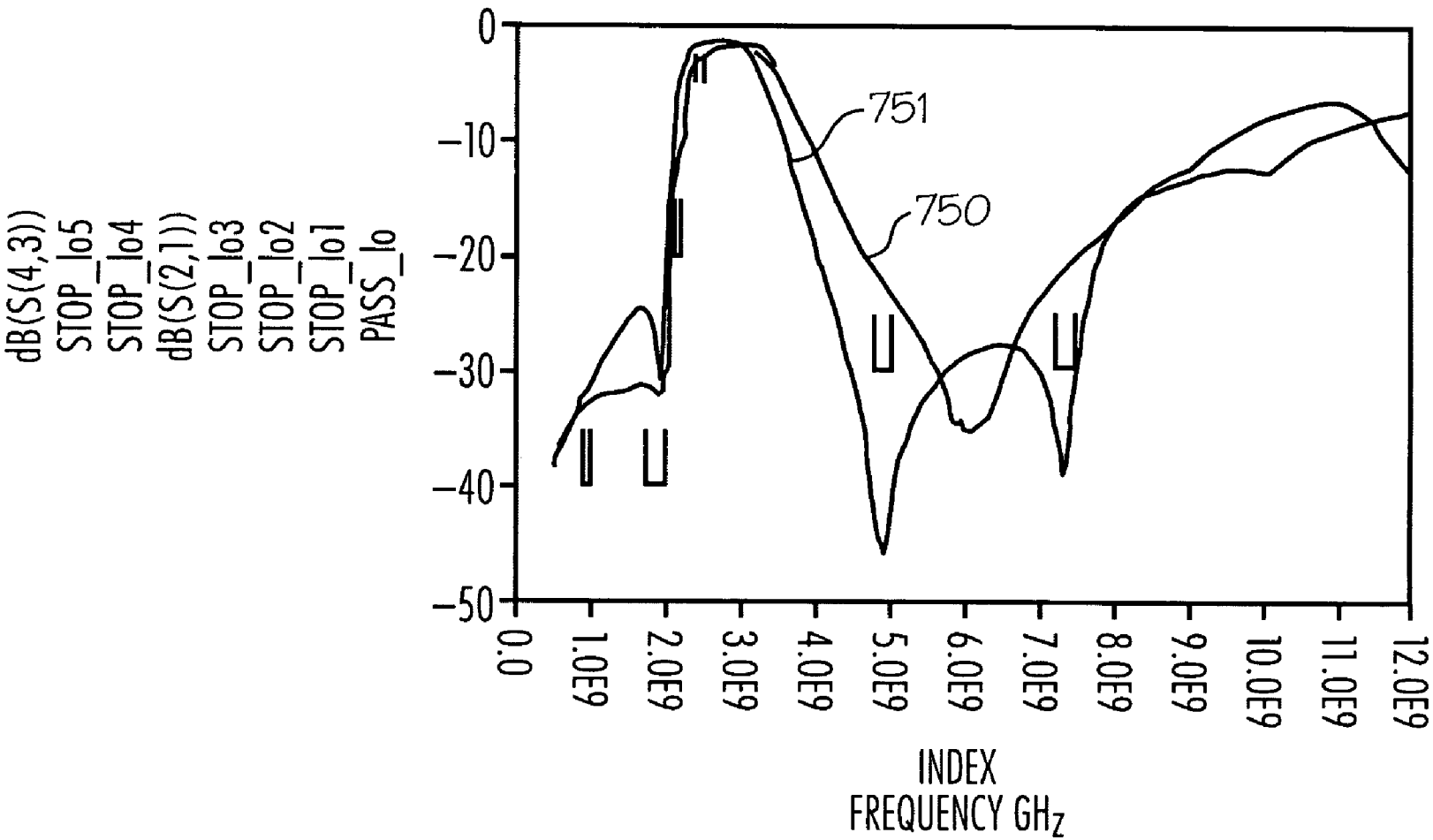
FIG. 7 depicts frequency response comparison of bandpass filters according to one embodiment of the invention.

FIG. 7 shows a comparison of filter transmission performance between conventional filters where all resonators use the shared common ground connection (response 750) and a filter using the grounding strategy of the invention (response 751). As can be seen in FIG. 7, response 751 exhibits higher and sharper attenuation in the upper stopband, as well as an additional transmission zero.

Figure 8:
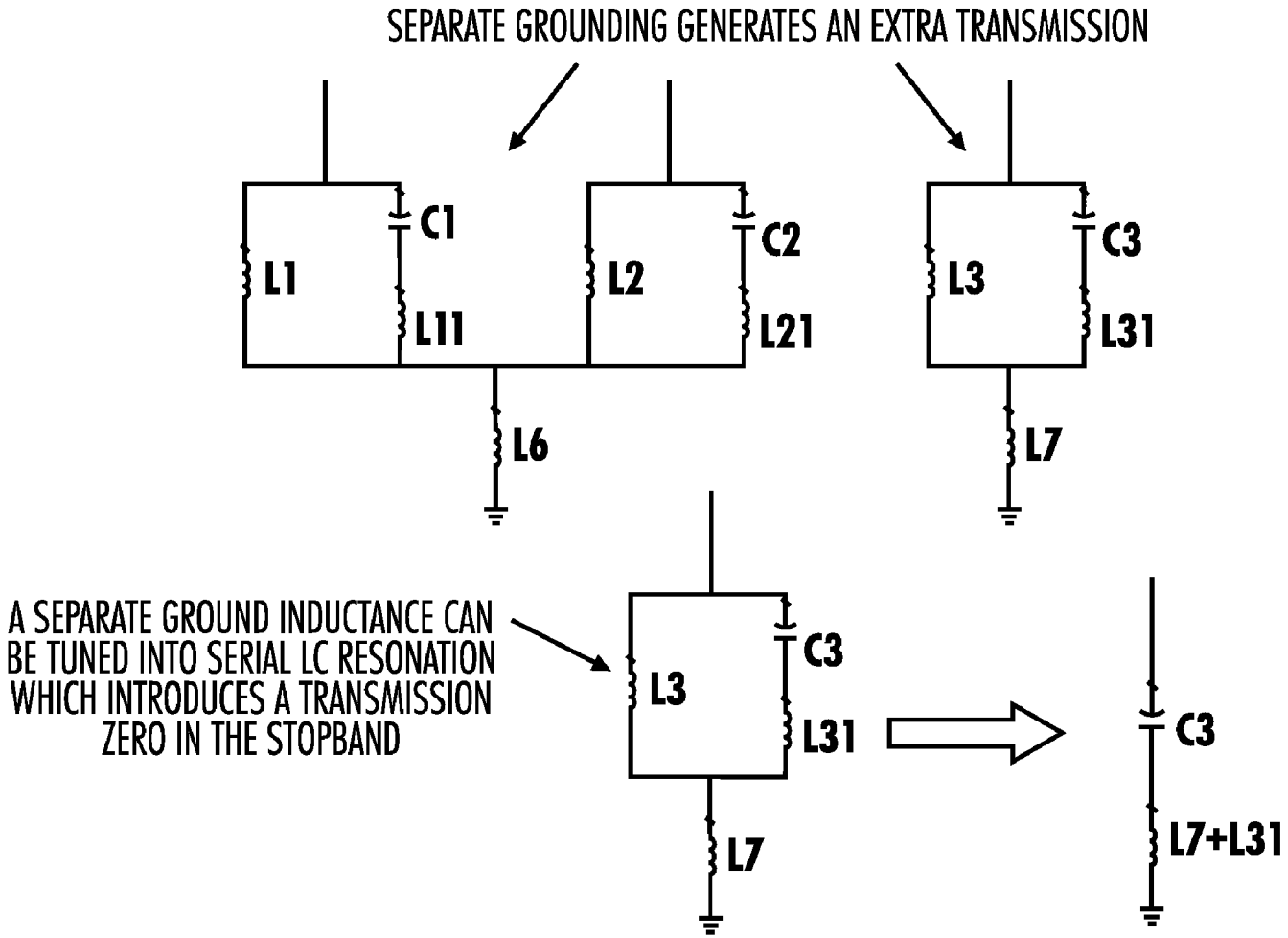
FIG. 8 depicts a schematic of resonators according to one embodiment of the invention.

With separated grounding for each group of resonators in a filter, the parasitic ground inductance can be utilized in a beneficial way rather than taken in a harmful way where it causes undesired coupling among resonators. FIG. 8 explains how a serial resonance can be achieved and an additional transmission zero can be generated in the stop-band by utilizing the ground inductance. It can be seen in FIG. 7 that an extra transmission zero has been generated and tuned to a position right below third harmonic frequency f3 at around 7.4 GHz. This transmission zero location can be tuned by changing the third LC resonator capacitor C3. Due to separate grounding, the other transmission zero can now also be individually tuned. In the example shown in FIG. 7, the other transmission zero has been tuned to be at the second harmonic frequency f2 of about 5 GHz. This method allows stop-band rejection requirement at both second and third harmonic frequencies to be met.

FIGS. 9*a-c* and 10 depict another embodiment of the invention where the ground connections 870 (L6) and 871 (L7) are configured as the sidewall terminations on the shorter side of the filter package (housing) rather than the longer side. Instead, the sidewall terminations on the longer side of the filter package (housing) are utilized as input terminal 850 and output terminal 860. Again, the physical layout of the bandpass filter shown in FIG. 9*a* features two resonators 830 connected to ground 870 (L6), while resonator 831 is connected to ground 871 (L7).

Figure 9A:
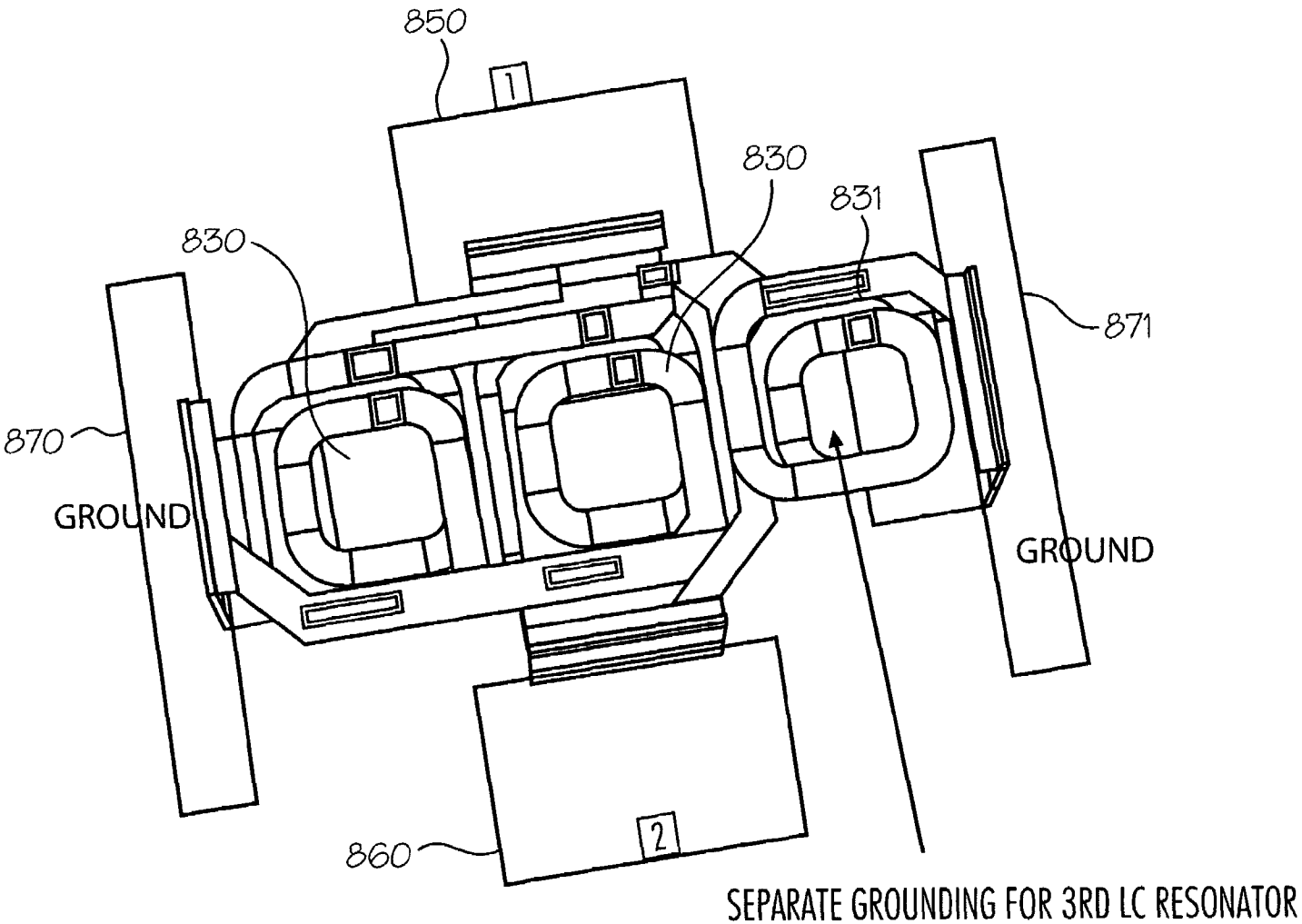
FIG. 9*a* depicts an isometric view of a physical layout of a bandpass filter according to one embodiment of the invention.
Figure 9B:
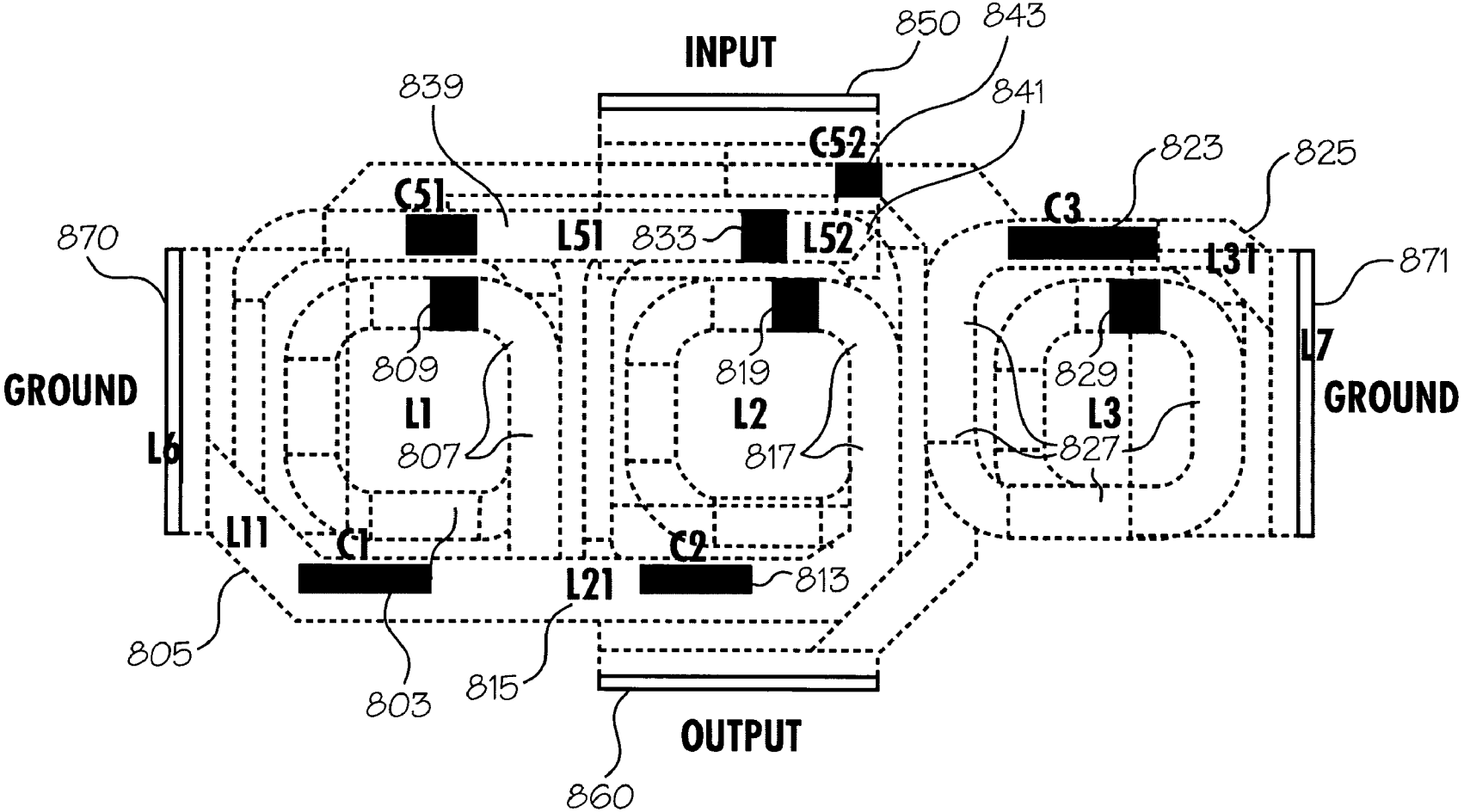
FIG. 9*b* depicts a physical layout of the top metal layer of the bandpass filter shown in FIG. 9*a* according to one embodiment of the invention.
Figure 9C:
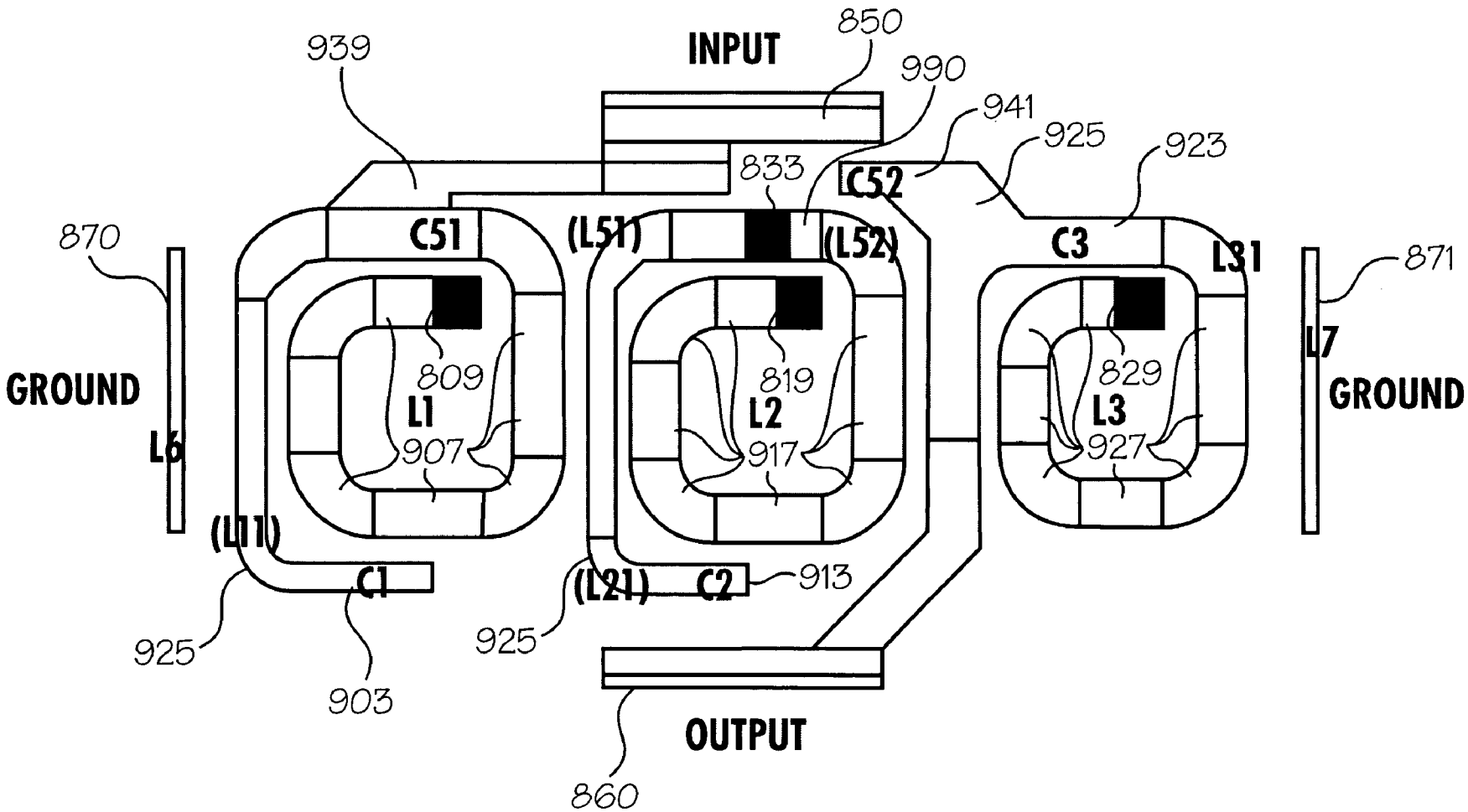
FIG. 9*c* depicts a physical layout of the bottom metal layer of the bandpass filter shown in FIG. 9*a* according to one embodiment of the invention.

FIG. 9*b* depicts a physical layout of the top layer of the bandpass filter shown in FIG. 9*a*. FIG. 9*c* depicts a physical layout of the bottom layer of the bandpass filter shown in FIG. 9*a*. It should be noted that the top and bottom layers depicted in FIGS. 9*b* and 9*c* may be reversed.

As shown in FIG. 9*b*, the first (L1, L11, and C1), second (L2, L21, and C2), and third (L3, L31, C3) resonators are partially formed in the top metal layer. Metal region 803 forms the top plate of a metal-insulator-metal (MIM) capacitor C1. Metal region 803 (C1) is connected to metal regions 807 (L1) and metal region 805 (L11). Metal region 807 (L1) is connected to the remainder of inductor L1 on the bottom layer through via 809. Functionally, metal regions 803 and 805 together create an inductor L11 in series with capacitor C1 formed by metal region 803. This series LC circuit (i.e., C1 and L11) is in parallel with inductor L1 to form an LC resonator.

Metal region 807 (L1) is connected to metal region 815 (L21) to connect the first LC resonator (L1, L11, and C1) to the second LC resonator (L2, L21, and C2). Metal region 813 forms the top plate of MIM capacitor C2. Metal region 813 (C2) is connected to metal regions 817 (L2) and metal region 815 (L21). Metal region 817 (L2) is connected to the remainder of inductor L2 on the bottom layer through via 819. Functionally, metal regions 813 and 815 together create an inductor L21 in series with capacitor C2 formed by metal region 813. This series LC circuit (i.e., C2 and L21) is in parallel with inductor L2 to form an LC resonator.

Metal region 823 forms the top plate of MIM capacitor C3. Metal region 823 (C3) is connected to metal regions 827 (L3) and to metal region 825 (L31). Metal region 827 (L3) is connected to the remainder of inductor L3 on the bottom layer through via 829. Functionally, metal regions 823 and 825 together create an inductor L31 in series with capacitor C3 formed by metal region 823. This series LC circuit (i.e., C3 and L31) is in parallel with inductor L3 to form an LC resonator.

The first two LC resonator circuits (L1/C1/L11 and L2/C2/L21) are tied to ground 870 (here a sidewall termination) through metal region 805 (L11). The third resonator (L3/C3/L31) is connected to ground 871 through metal region 825 (L31)

A coupling network is also partially contained in the top metal layer. Metal region 839 forms both the top plate of MIM capacitor C51 and inductor L51. Likewise metal region 841 forms both the top plate of MIM capacitor C52 and inductor L52. Metal regions 839 and 841 are connected to the remainder of the coupling network on the bottom layer through via 833.

Turning now to the bottom layer shown in FIG. 9*c*, metal region 850 (input terminal) is connected to metal regions 907 (L1) through metal region 939 which forms the bottom plate of MIM capacitor C51. Metal region 907 is also connected to metal region 903 which forms the bottom plate of MIM capacitor C1. Metal region 907 is connected to metal region 939 which forms the bottom plate of MIM capacitor C51. Metal regions 907 form the other portion of inductor L1 in the bottom layer. This portion of inductor L1 is connected to the remainder of the inductor on the upper layer through via 809.

Metal region 913 forms the bottom plate of MIM capacitor C2. Metal region 913 is connected to metal region 990 which in turn connects the second resonator (i.e., L2, L21, and C2) to the coupling network through via 833. Metal region 990 is also connected to metal regions 917 which form the other portion of inductor L2 in the bottom layer. This portion of inductor L2 is connected to the remainder of the inductor on the upper layer through via 819.

Metal region 923 forms the bottom plate of MIM capacitor C3. Metal region 923 is connected to metal region 941 which forms the bottom plate of MIM capacitor C52. Metal region 923 (C3) is also connected to metal regions 927 which form the other portion of inductor L3 in the bottom layer. This portion of inductor L1 is connected to the remainder of the inductor on the upper layer through via 829. Metal region 923 (C3) is also connected to metal region 960 (output port) through metal region 935.

Turning now to the remainder of the coupling network, metal region 941 forms the lower plate of MIM capacitor C51.

Figure 10:
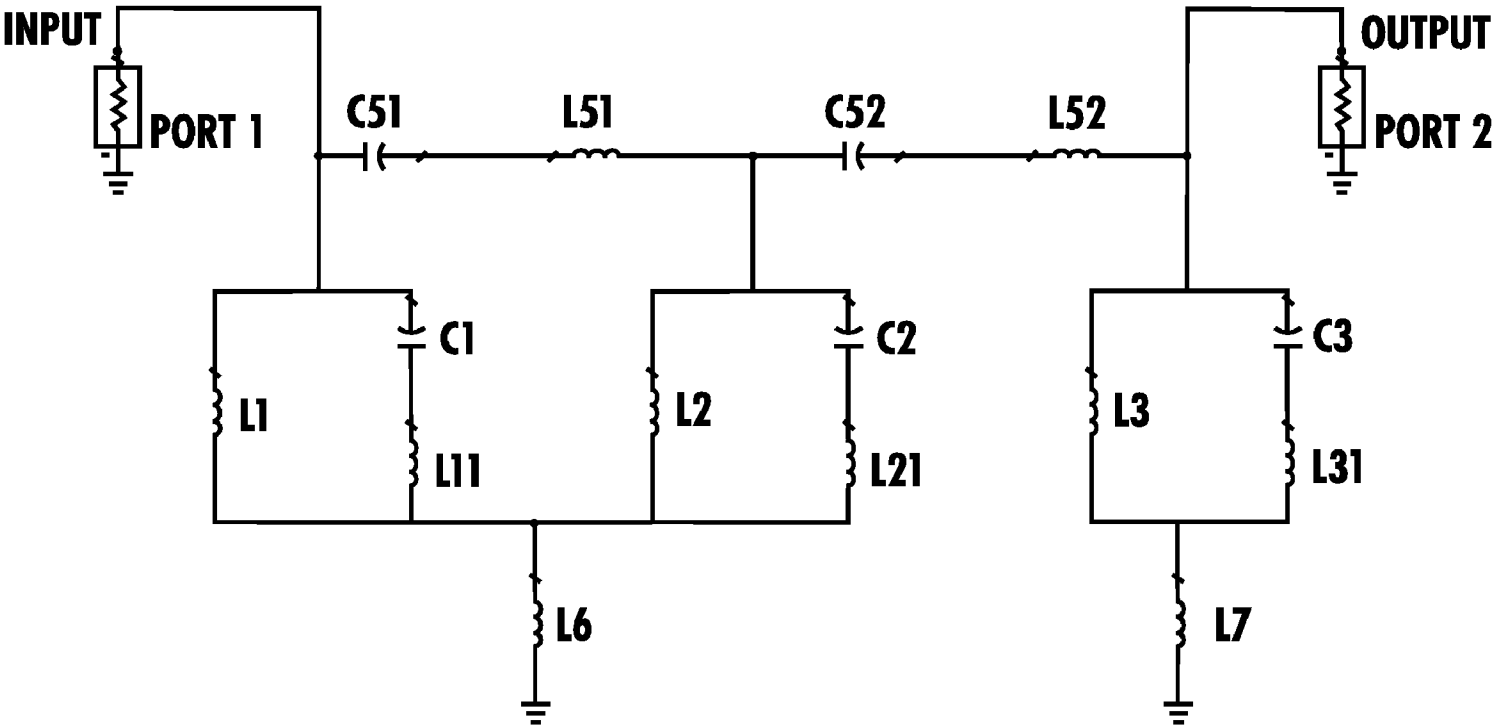
FIG. 10 depicts a schematic of the bandpass filter shown in FIG. 9*a* according to one embodiment of the invention.

As can be seen in FIG. 10, the schematic of this layout differs from the one shown in FIG. 5 since there is no series LC resonator coupling the first and third resonators and the input and output terminals. The input/output coupling capacitor C4 can be omitted in certain cases if its value becomes very small. In that case, only weak coupling between input and output terminals is required. That weak coupling can be obtained by the magnetic coupling between the first resonator inductor coil L1 and the third resonator inductor coil L3. This mutual coupling exists when the two inductor coils are physically close to each other.

FIGS. 11*a-c* and 12 depict another embodiment of the invention where the first (i.e., the left most) resonator 1031 is connected to upper ground connection 1071 while the second and third resonators 1030 are connected to ground terminal 1070.

Figure 11A:
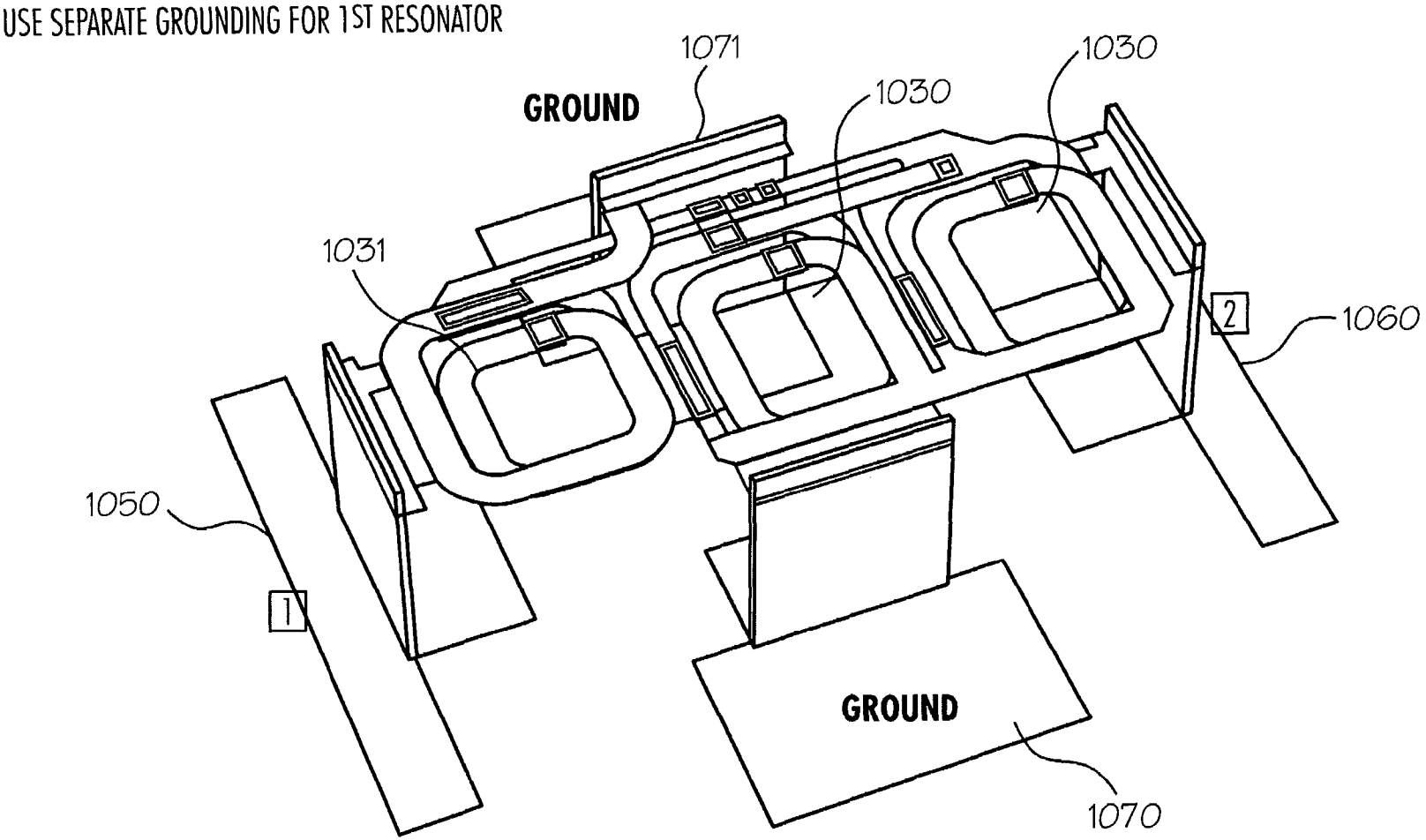
FIG. 11*a* depicts an isometric view of a physical layout of a bandpass filter according to one embodiment of the invention.
Figure 11B:
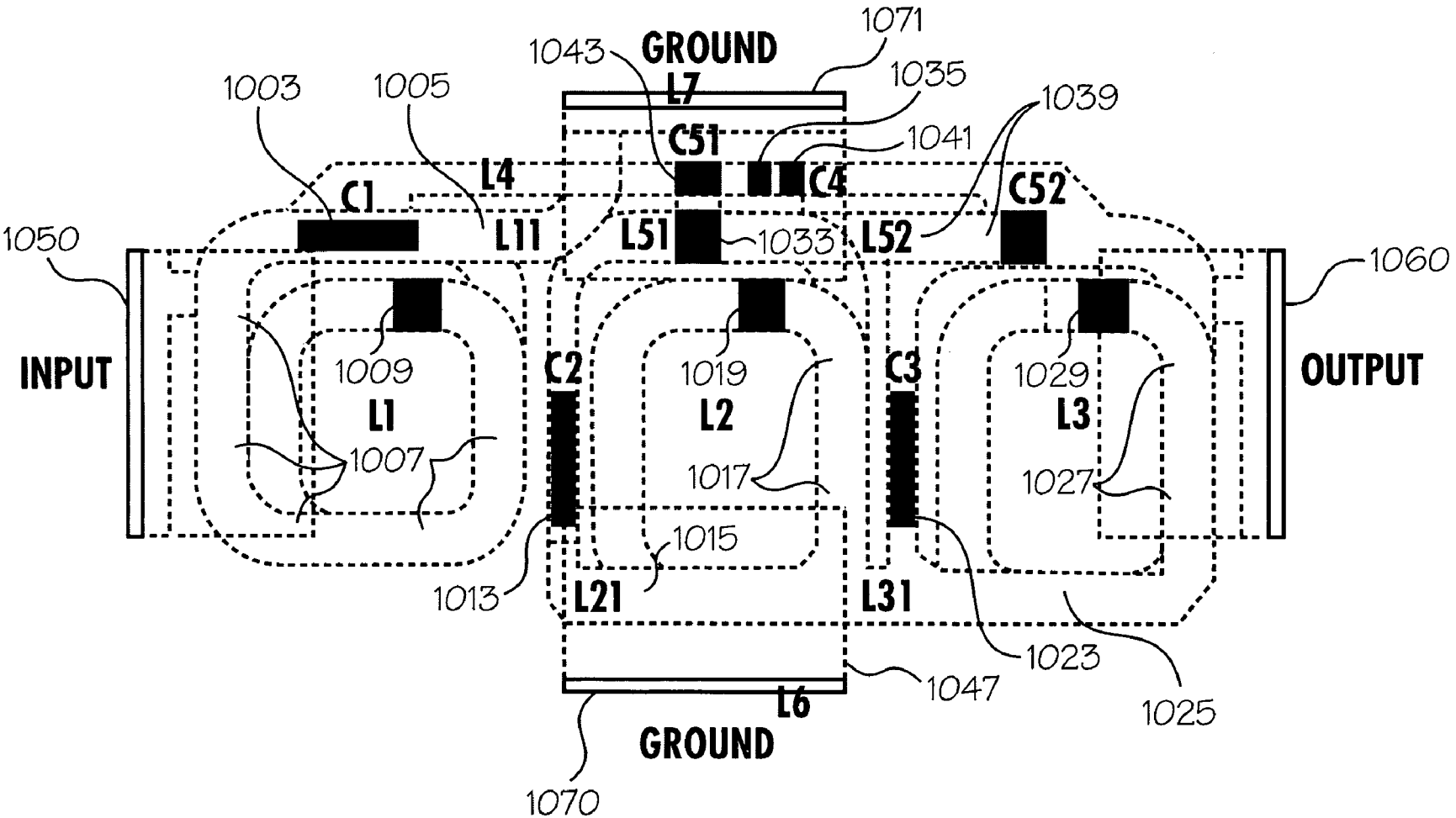
FIG. 11*b* depicts a physical layout of the top metal layer of the bandpass filter shown in FIG. 11*a* according to one embodiment of the invention.
Figure 11C:
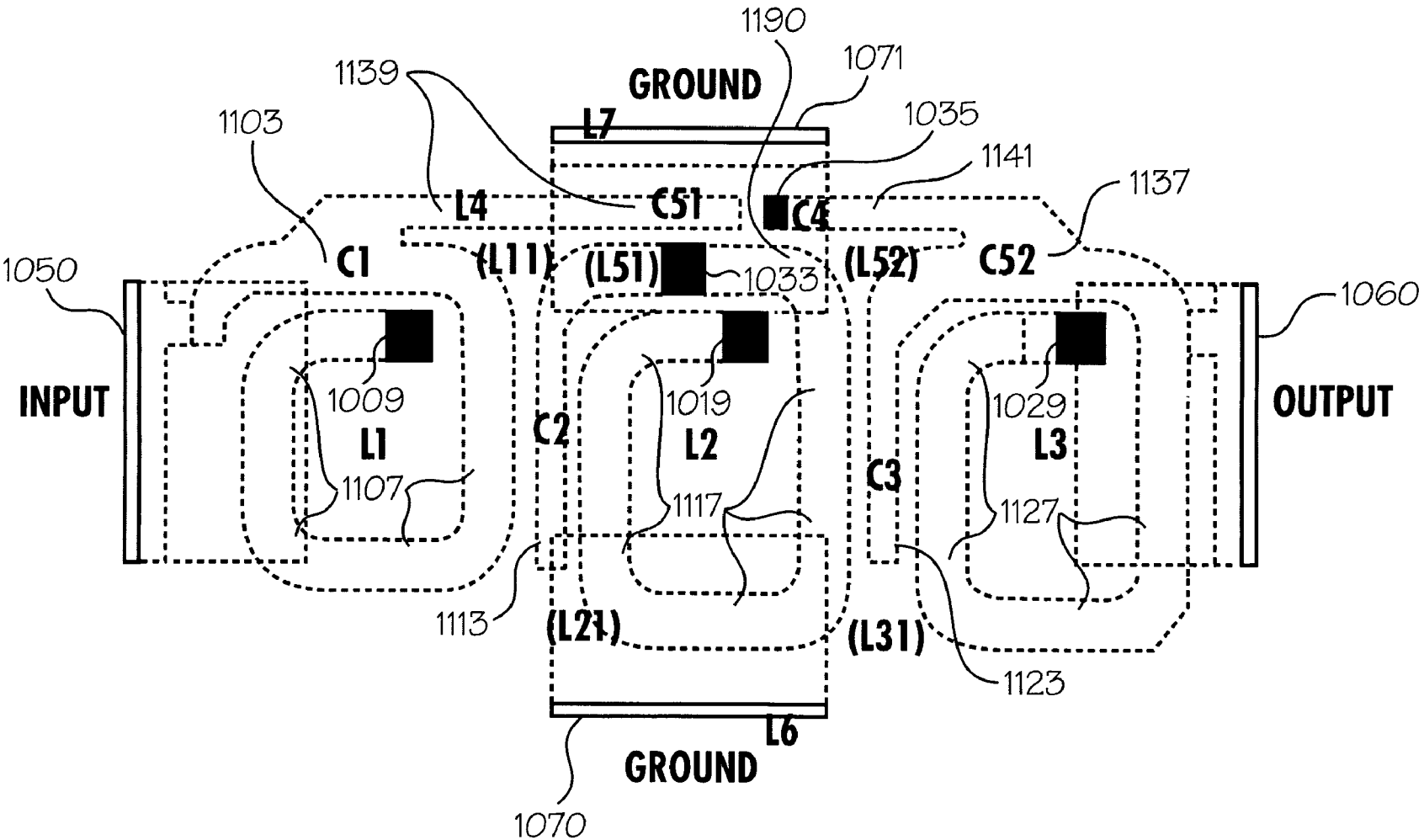
FIG. 11*c* depicts a physical layout of the bottom metal layer of the bandpass filter shown in FIG. 11*a* according to one embodiment of the invention.
Figure 12:
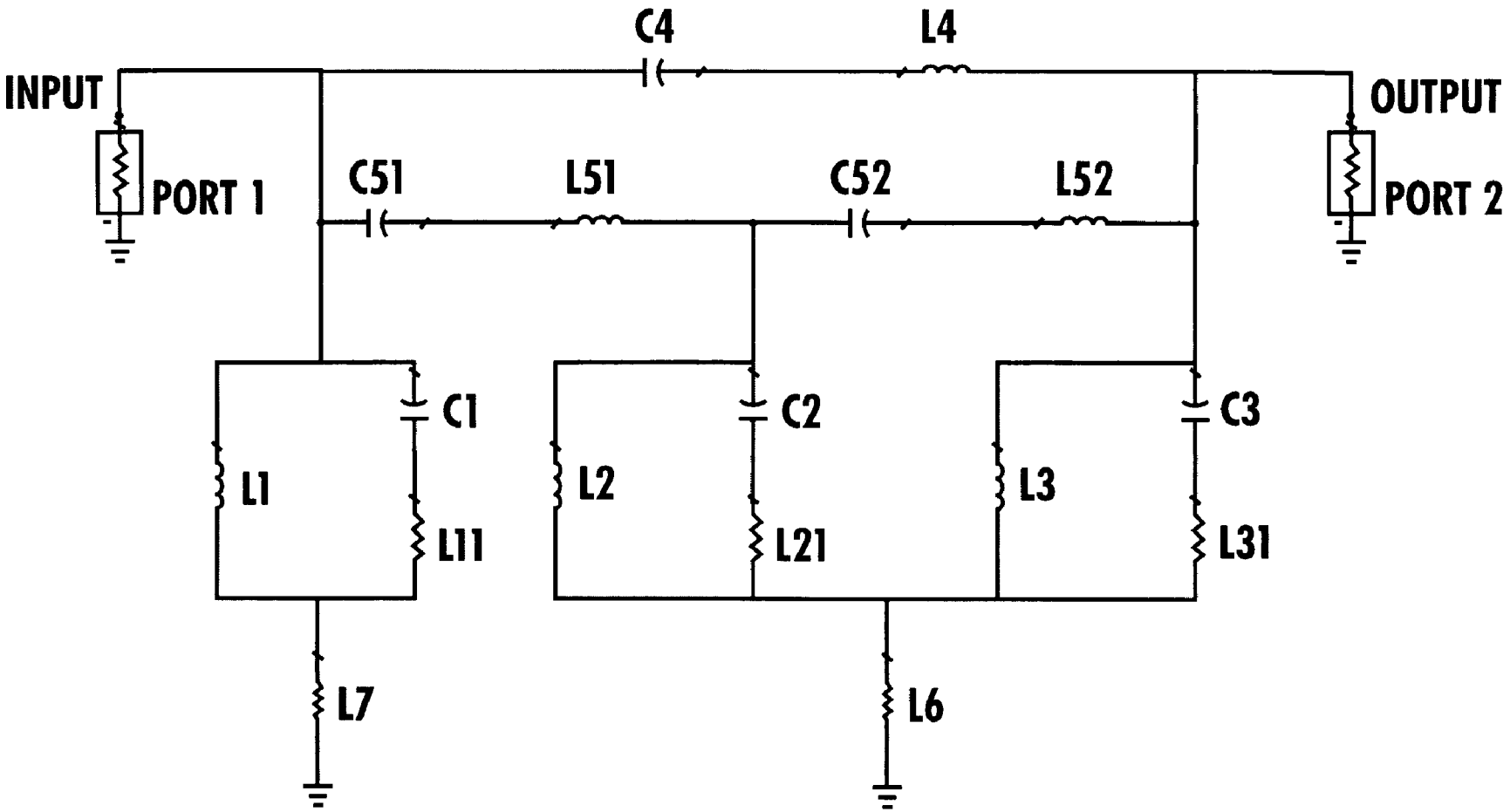
FIG. 12 depicts a schematic of the bandpass filter shown in FIG. 11*a* according to one embodiment of the invention.

FIG. 11*b* depicts a physical layout of the top layer of the bandpass filter shown in FIG. 11*a*. FIG. 11*c* depicts a physical layout of the bottom layer of the bandpass filter shown in FIG. 11*a*. It should be noted that the top and bottom layers depicted in FIGS. 11*b* and 11*c* may be reversed.

As shown in FIG. 11*b*, the first (L1, L11, and C1), second (L2, L21, and C2), and third (L3, L31, C3) resonators are partially formed in the top metal layer. Metal region 1003 forms the top plate of a metal-insulator-metal (MIM) capacitor C1. Metal region 1003 (C1) is connected to metal regions 1007 (L1) and metal region 1005 (L11). Metal region 1007 (L1) is connected to the remainder of inductor L1 on the bottom layer through via 1009. Functionally, metal regions 1003 and 1005 together create an inductor L11 in series with capacitor C1 formed by metal region 1003. This series LC circuit (i.e., C1 and L11) is in parallel with inductor L1 to form an LC resonator.

Metal region 1013 forms the top plate of MIM capacitor C2. Metal region 1013 (C2) is connected to metal regions 1017 (L2) via metal region 1015 (L21). Metal region 1017 (L2) is connected to the remainder of inductor L2 on the bottom layer through via 1019. Functionally, metal regions 1013 and 1015 together create an inductor L21 in series with capacitor C2 formed by metal region 1013. This series LC circuit (i.e., C2 and L21) is in parallel with inductor L2 to form an LC resonator.

Metal region 1023 forms the top plate of MIM capacitor C3. Metal region 1023 (C3) is connected to metal regions 1027 (L3) and to metal region 1025 (L31). Metal region 1027 (L3) is connected to the remainder of inductor L3 on the bottom layer through via 1029. Functionally, metal regions 1023 and 1025 together create an inductor L31 in series with capacitor C3 formed by metal region 1023. This series LC circuit (i.e., C3 and L31) is in parallel with inductor L3 to form an LC resonator.

The second two LC resonator circuits (L3/C3/L31 and L2/C2/L21) are tied to ground 1070 (here a sidewall termination) through metal region 1047 (metal region 1047 together with ground 1070 form L6). Metal region 1047 is connected to metal region 1017 (L2) which in turn is connected to metal region 1027 (L3) through metal region 1025 (L31). The third resonator (L3/C3/L31) is connected to ground 1071 (L7) through metal region 1005 (L11).

A coupling network is also partially contained in the top metal layer. Metal region 1039 forms both the top plate of MIM capacitor C52 and inductor L52. Likewise metal region 1043 forms both the top plate of MIM capacitor C51 and inductor L51. Metal regions 1039 and 1043 are connected to the remainder of the coupling network on the bottom layer through via 1033. In addition, metal region 1041 forms the top plate of MIM capacitor C4. This capacitor is connected to the remainder of the coupling network on the bottom layer through via 1035.

Turning now to the bottom layer shown in FIG. 11*c*, metal region 1050 (input terminal) is connected to metal region 1103 (C1). Metal region 1103 forms the bottom plate of MIM capacitor C1. Metal region 1103 is connected to metal region 1139 which forms the bottom plate of MIM capacitor C51. Metal region 1139 (C51) is also connected to metal regions 1107 which form the other portion of inductor L1 in the bottom layer. This portion of inductor L1 is connected to the remainder of the inductor on the upper layer through via 1009.

Metal region 1113 forms the bottom plate of MIM capacitor C2. Metal region 1113 is connected to metal region 1190 which in turn connects the second resonator (i.e., L2, L21, and C2) to the coupling network through via 1033. Metal region 1190 is also connected to metal regions 1117 which form the other portion of inductor L2 in the bottom layer. This portion of inductor L2 is connected to the remainder of the inductor on the upper layer through via 1019.

Metal region 1123 forms the bottom plate of MIM capacitor C3. Metal region 1123 is connected to metal region 1137 which forms the bottom-plate of MIM capacitor C52. Metal region 1137 (C52) is also connected to metal regions 1127 which form the other portion of inductor L3 in the bottom layer. This portion of inductor L1 is connected to the remainder of the inductor on the upper layer through via 1029. Metal region 1137 (C52) is also connected to metal region 1060 (output port).

Turning now to the remainder of the coupling network, metal region 1141 forms the lower plate of MIM capacitor C4. Metal region 1141 connects to the remainder of the coupling network, specifically metal region 1041 (the upper plate of capacitor C4), through via 1035.

Other embodiments of the invention will be apparent to those skilled in the art from consideration of the specification and embodiments disclosed herein. Thus, the specification and examples are exemplary only, with the true scope and spirit of the invention set forth in the following claims and legal equivalents thereof.

What is claimed is:

1. An electronic component comprising:

a first group of one or more resonators located in a first group of two or more thin-film layers;

a second group of one or more resonators located in a second group of two or more thin-film layers;

a first ground connection; and a second ground connection, wherein each resonator in the first group of one or more resonators is connected to the first ground connection, each resonator in the second group of one or more resonators is connected to the second ground connection, and wherein the connection of the first group of one or more resonators to the first ground connection has a first parasitic inductance and the connection of the second group of one or more resonators to the second ground connection has a second parasitic inductance, the first parasitic inductance being different from the second parasitic inductance.

2. The electronic component of claim 1, wherein the first group of two or more thin-film layers and the second group of two or more thin-film layers are the same layers.

3. The electronic component of claim 1, wherein the first ground connection and the second ground connection are sidewall terminations.

4. The electronic component of claim 1, wherein the first and second ground connections are constructed as sidewall terminations on the two longer sides of a housing and the input connection and the output connection are constructed as sidewall terminations on the two shorter sides of the housing.

5. The electronic component of claim 1, wherein the first and second ground connections are constructed as sidewall terminations on the two shorter sides of a housing and the input connection and the output connection are constructed as sidewall terminations on the two longer sides of the housing.

6. An electronic component comprising:

a first group of one or more resonators located in a first group of two or more thin-film layers;

a second group of one or more resonators located in a second group of two or more thin-film layers;

a first ground connection; and a second ground connection, wherein each resonator in the first group of one or more resonators is connected to the first ground connection, each resonator in the second group of one or more resonators is connected to the second ground connection, and wherein the first group of one or more resonators has substantially the same size and shape as each other, while the second group of or one or more resonators has a different size and/or shape than the first group of resonators of two or more resonators.

7. The electronic component of claim 6, wherein the first group of two or more thin-film layers and the second group of two or more thin-film layers are the same layers.

8. The electronic component of claim 6, wherein the first ground connection and the second ground connection are sidewall terminations.

9. The electronic component of claim 6, wherein the first and second ground connections are constructed as sidewall terminations on the two longer sides of a housing and the input connection and the output connection are constructed as sidewall terminations on the two shorter sides of the housing.

10. The electronic component of claim 6, wherein the first and second ground connections are constructed as sidewall terminations on the two shorter sides of a housing and the input connection and the output connection are constructed as sidewall terminations on the two longer sides of the housing.

11. An electronic component comprising:

a first group of one or more resonators located in a first group of two or more thin-film layers;

a second group of one or more resonators located in a second group of two or more thin-film layers;

a first ground connection; and a second ground connection, wherein each resonator in the first group of one or more resonators is connected to the first ground connection, each resonator in the second group of one or more resonators is connected to the second ground connection, and wherein the first group of one or more resonators consist of two resonators, the second group of one or more resonators consists of one resonator, the first group of two or more thin-film layers consist of two thin-film layers, and the second group of two or more thin-film layers consists of two thin-film layers.

12. The electronic component of claim 11, wherein the first group of two or more thin-film layers and the second group of two or more thin-film layers are the same layers.

13. The electronic component of claim 11, wherein the first ground connection and the second ground connection are sidewall terminations.

14. The electronic component of claim 11, wherein the first and second ground connections are constructed as sidewall terminations on the two longer sides of a housing and the input connection and the output connection are constructed as sidewall terminations on the two shorter sides of the housing.

15. The electronic component of claim 11, wherein the first and second ground connections are constructed as sidewall terminations on the two shorter sides of a housing and the input connection and the output connection are constructed as sidewall terminations on the two longer sides of the housing.

* * * * *